US008616758B2

(12) United States Patent
Takahashi

(10) Patent No.: US 8,616,758 B2
(45) Date of Patent: Dec. 31, 2013

(54) MIXER DRUM DRIVING DEVICE

(75) Inventor: Yoshimitsu Takahashi, Fukaya (JP)

(73) Assignee: Kayaba Industry Co., Ltd., Tokyo (JP)

( * ) Notice: Subject to any disclaimer, the term of this patent is extended or adjusted under 35 U.S.C. 154(b) by 0 days.

(21) Appl. No.: 13/809,210

(22) PCT Filed: Mar. 12, 2012

(86) PCT No.: PCT/JP2012/056237
§ 371 (c)(1),
(2), (4) Date: Jan. 9, 2013

(87) PCT Pub. No.: WO2012/128091
PCT Pub. Date: Sep. 27, 2012

(65) Prior Publication Data

US 2013/0111892 A1 May 9, 2013

(30) Foreign Application Priority Data

Mar. 24, 2011 (JP) ..... 2011-065504

(51) Int. Cl.
*B28C 5/42* (2006.01)

(52) U.S. Cl.
USPC ..... 366/61; 60/462

(58) Field of Classification Search
USPC ..... 366/53–63, 232–233; 60/452, 422, 60/462–465, 459
See application file for complete search history.

(56) References Cited

U.S. PATENT DOCUMENTS

| | | | | |
|---|---|---|---|---|
| 5,746,509 | A * | 5/1998 | Gebhard et al. | 366/61 |
| 6,074,083 | A * | 6/2000 | Gebhard et al. | 366/61 |
| 6,286,987 | B1 * | 9/2001 | Goode et al. | 366/60 |
| 7,467,889 | B2 * | 12/2008 | Abe et al. | 366/61 |
| 2007/0280035 | A1 * | 12/2007 | Abe et al. | 366/31 |
| 2008/0008025 | A1 * | 1/2008 | Abe et al. | 366/61 |
| 2008/0134674 | A1 * | 6/2008 | Geissler et al. | 60/464 |
| 2013/0021867 | A1 * | 1/2013 | Shimizu | 366/40 |
| 2013/0111892 | A1 * | 5/2013 | Takahashi | 60/459 |

FOREIGN PATENT DOCUMENTS

| | | | | |
|---|---|---|---|---|
| GB | 2103339 A | * | 2/1983 | F16H 39/46 |
| JP | 3-97474 U | | 10/1991 | |
| JP | 07329628 A | * | 12/1995 | B60P 3/16 |
| JP | 10-141108 A | | 5/1998 | |
| JP | 2000094432 A | * | 4/2000 | B28C 5/42 |

(Continued)

OTHER PUBLICATIONS

International Search Report and Written Opinion corresponding to PCT/JP2012/056237, dated Jun. 5, 2012.

*Primary Examiner* — Charles E Cooley
(74) *Attorney, Agent, or Firm* — Lowe, Hauptman & Ham LLP

(57) ABSTRACT

A mixer drum driving device includes a hydraulic motor that rotates a mixer drum, a first hydraulic pump that is driven by an engine to be capable of supplying working oil to the hydraulic motor, an electric motor, a power supply connected to the electric motor, a second hydraulic pump capable of supplying the working oil to the hydraulic motor on the basis of a driving force of the motor, and a flow dividing valve that divides the working oil discharged from the first hydraulic pump and supplies the working oil to the hydraulic motor and the second hydraulic pump. The second hydraulic pump is configured to rotate the electric motor using the working oil. The electric motor is configured to generate electric power so as to charge the power supply when driven to rotate by the second hydraulic pump.

4 Claims, 3 Drawing Sheets

(56) References Cited

FOREIGN PATENT DOCUMENTS

| | | | | | |
|---|---|---|---|---|---|
| JP | 2000272406 | A | * | 10/2000 | ..... B60P 3/16 |
| JP | 2003-301802 | A | | 10/2003 | |
| JP | 2007-278430 | A | | 10/2007 | |
| JP | 2007320477 | A | * | 12/2007 | |
| JP | 2008024260 | A | * | 2/2008 | |
| JP | 2008-202343 | A | | 9/2008 | |

* cited by examiner

MIXER DRUM DRIVING DEVICE

TECHNICAL FIELD

This invention relates to a mixer drum driving device that drives a mixer drum of a mixer truck.

BACKGROUND ART

A mixer truck is a vehicle that carries fresh concrete such as mortar or ready mixed concrete in a mixer drum mounted on a frame to be free to rotate, and transports the fresh concrete from a fresh concrete factory to a construction site.

The mixer truck prevents the fresh concrete from deteriorating in quality and hardening by rotating the mixer drum in a positive direction while transporting the fresh concrete and stirring the fresh concrete using a plurality of helical blades disposed in the mixer drum. Further, the mixer truck is configured to be capable of discharging the fresh concrete in the mixer drum by rotating the mixer drum in an opposite direction to the positive direction. Upon arrival at a concrete placement site, the mixer truck supplies the fresh concrete to a placement location by rotating the mixer drum in reverse.

In this type of mixer truck, the mixer drum must be rotated constantly until the fresh concrete is discharged. An engine of the mixer truck is typically used as a drive source of the mixer drum. More specifically, power from the engine is transmitted to a hydraulic pump via a PTO (Power Take Off), working oil discharged from the hydraulic pump is supplied to a hydraulic motor, and the mixer drum is driven to rotate by rotation of the hydraulic motor, which is driven by the working oil.

In a mixer drum driving device that drives the mixer drum using the engine alone, an engine rotation speed must be increased in order to rotate the mixer drum at a high speed or the like. When the engine rotation speed is increased, noise is generated and fuel consumption increases.

Further, while the fresh concrete is carried in the mixer drum, the mixer drum must be rotated continuously to prevent hardening and the like, and therefore the engine cannot be stopped. Hence, the engine must be driven continuously even when the mixer truck remains stationary while waiting in line to discharge the fresh concrete at the placement site.

JP2007-278430A and JP2003-301802A disclose mixer drum driving devices that drive a mixer drum to rotate by driving a secondary hydraulic pump using a motor as well as driving a main hydraulic pump using an engine.

SUMMARY OF INVENTION

In the mixer drum driving device disclosed in JP2007-278430A, the main hydraulic pump driven by the engine is assisted by the secondary hydraulic pump driven by the motor, and therefore increases in noise generation and fuel consumption can be suppressed. However, electric power must be supplied to the motor from a battery of the mixer truck in order to drive the motor. A large amount of electric power is required to drive a mixer drum carrying fresh concrete to rotate, and therefore the battery cannot be charged sufficiently using an alternator that generates electric power as the engine rotates. Hence, the battery must be charged frequently from a commercial power supply.

Further, in the mixer drum driving device disclosed in JP2003-301802A, a power generator is installed in addition to the alternator of the vehicle to secure a large amount of electric power. In this type of mixer drum driving device, a weight of the mixer truck increases, and space for attaching the power generator must be secured.

This invention has been designed in consideration of the problems described above, and an object thereof is to provide a lightweight mixer drum driving device that can drive a mixer drum to rotate using a motor without the need for frequent charging of a power supply using a commercial power supply.

According to an aspect of this invention, a mixer drum driving device that is configured to rotate a mixer drum mounted on a frame of a mixer truck is provided. The mixer drum driving device includes a hydraulic motor that is configured to rotate the mixer drum, a first hydraulic pump that is configured to be driven by an engine of the mixer truck to be capable of supplying a working oil to the hydraulic motor, an electric motor that is configured to function as a drive source or a power generator, a power supply connected to the electric motor, a second hydraulic pump that is configured to be capable of supplying the working oil to the hydraulic motor on the basis of a driving force of the electric motor, and a flow dividing valve that is configured to divide the working oil discharged from the first hydraulic pump and to supply the working oil to the hydraulic motor and the second hydraulic pump. The second hydraulic pump is configured to rotate the electric motor when driven by the working oil supplied via the flow dividing valve. The electric motor is configured to generate electric power when driven to rotate by the second hydraulic pump and to supply the electric power to the power supply.

The details as well as other features and advantages of this invention are set forth in the remainder of the specification and are shown in the accompanying drawings.

DESCRIPTION OF EMBODIMENTS

Figure 1:
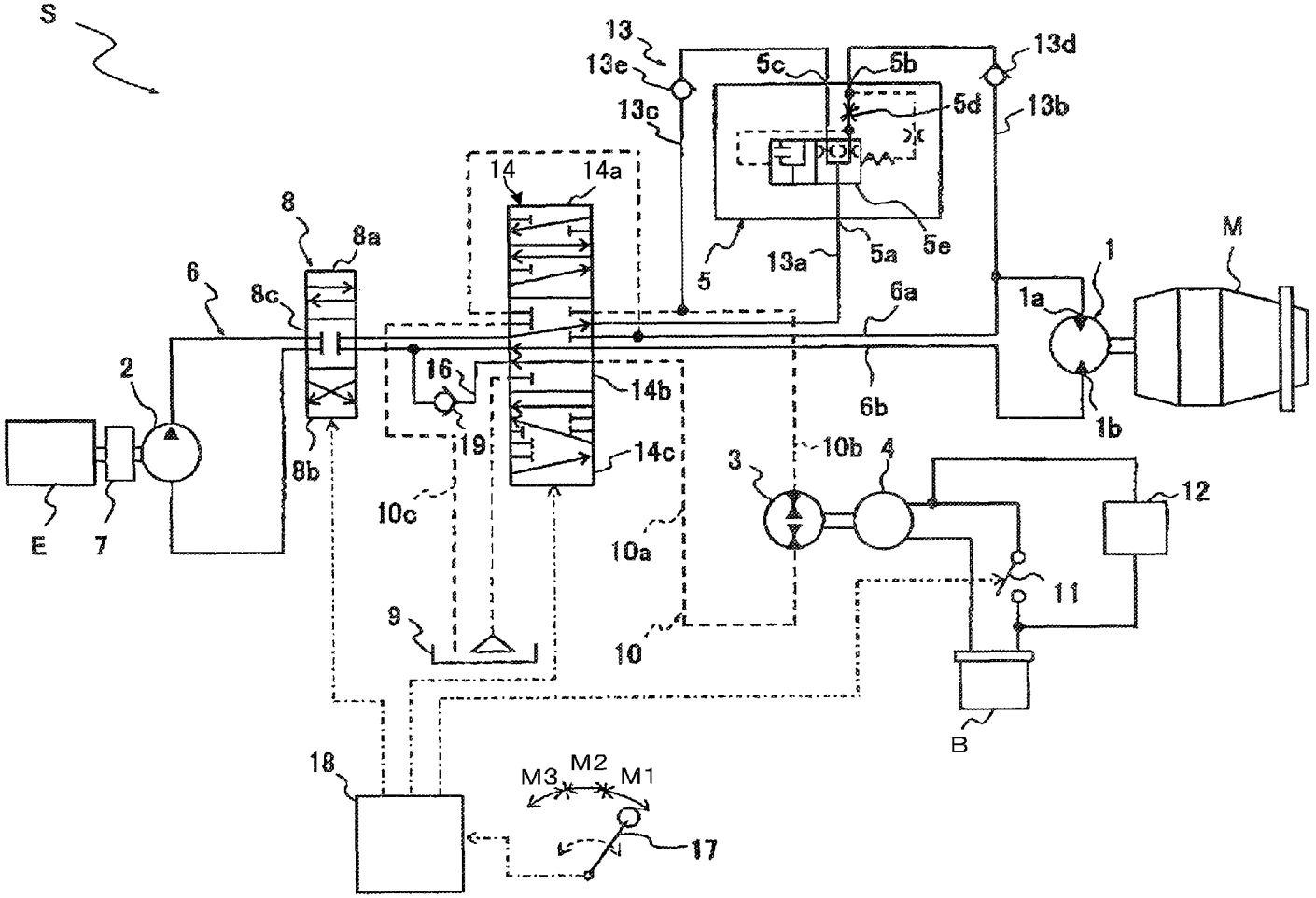
FIG. 1 is a schematic view of a mixer drum driving device according to an embodiment of this invention.
Figure 2:
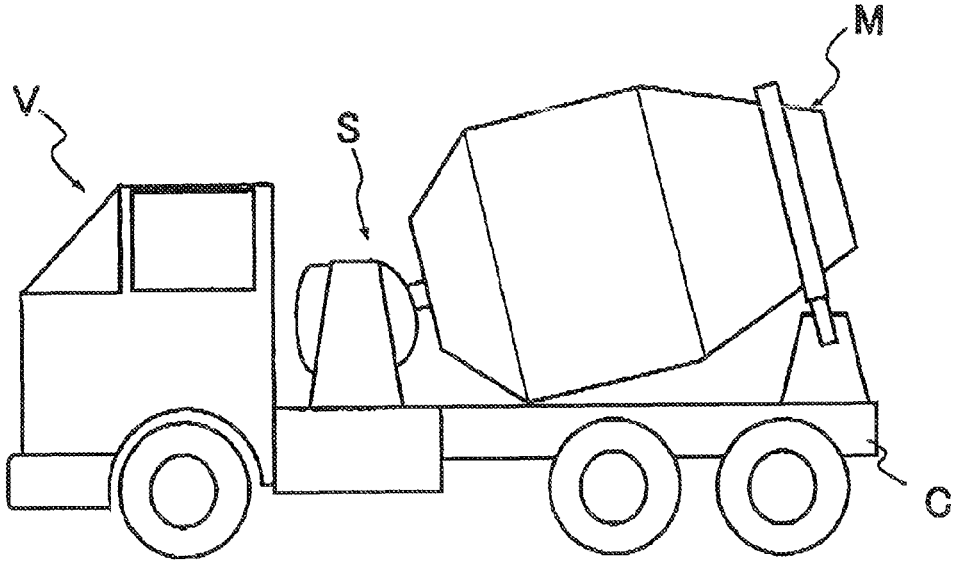
FIG. 2 is a side view of a mixer drum mounted on a frame of a mixer truck.
Figure 3:
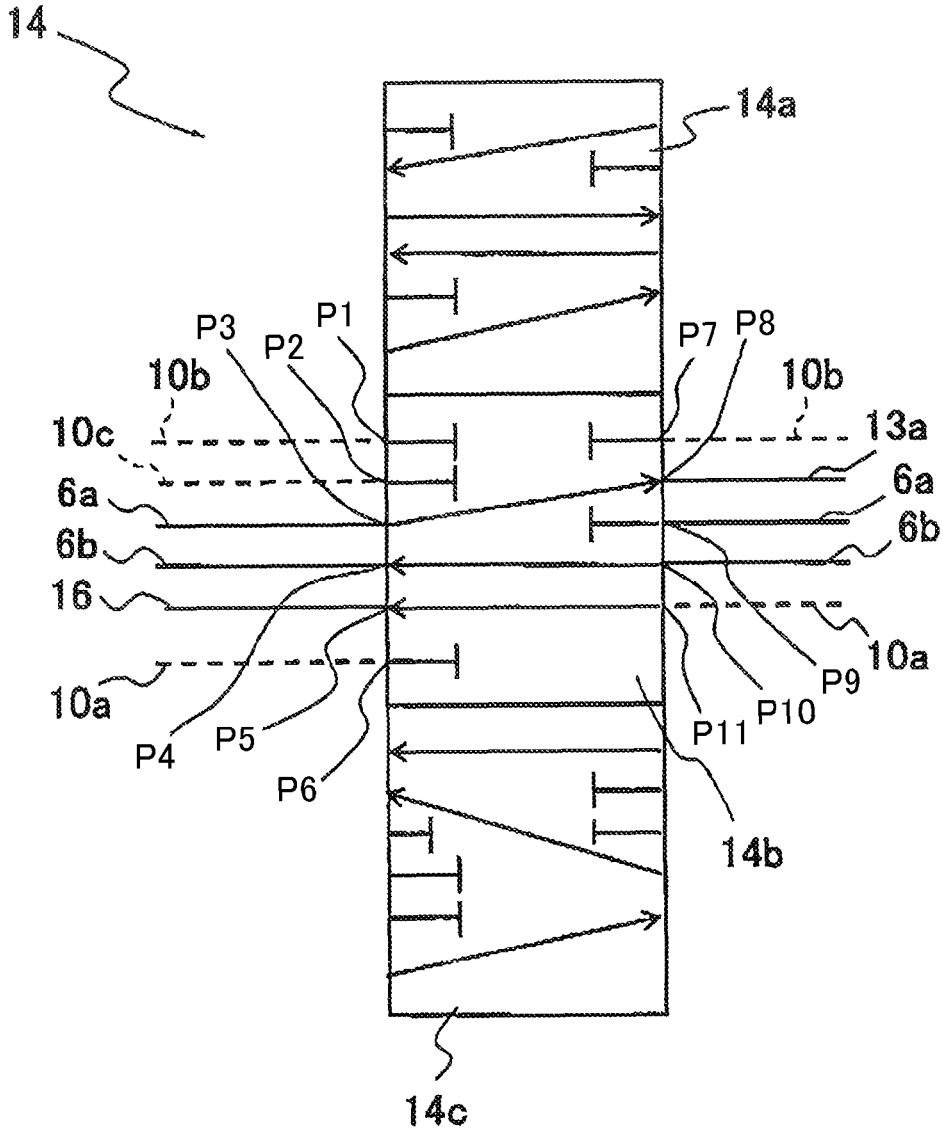
FIG. 3 is a schematic view of a second direction switching valve provided in the mixer drum driving device.

Referring to FIGS. 1 to 3, a mixer drum driving device according to an embodiment of this invention will be described.

As shown in FIG. 2, a mixer truck V includes a frame C provided on a rear of a cabin, and a mixer drum driving device S that rotates a mixer drum M mounted on the frame C.

The mixer drum M is formed in a closed-end cylindrical shape having an open rear end. The mixer drum M is mounted on the frame C to be free to rotate via a support portion provided in a rear portion of the frame C. The mixer drum M is disposed in a forward tilted attitude such that a drum rear end side is raised up. A hydraulic motor 1 (see FIG. 1) of the mixer drum driving device S is coupled to an axial central portion of a bottom portion forming a front end of the mixer drum M, and the mixer drum M rotates on the basis of power from the hydraulic motor 1.

A plurality of helical blades are provided on an inner peripheral surface of the mixer drum M. When the mixer drum M is driven to rotate in a positive direction by the hydraulic motor 1 of the mixer drum driving device S, the blades stir fresh concrete in the mixer drum M while moving the fresh concrete to a front side. To prevent the fresh concrete from hardening and suppress increases in a slump value thereof during stirring, the mixer drum M is rotated in the positive direction at a low speed of approximately 1 to 2 rpm, for example. The mixer drum M is also rotated in the positive direction when the fresh concrete is introduced into the mixer drum M, but a rotation speed during introduction is set to be higher than the rotation speed during stirring. When the mixer drum M is driven by the hydraulic motor 1 to rotate in reverse, on the other hand, the blades move the fresh concrete in the mixer drum M to the rear side so that the fresh concrete can be discharged from the mixer drum M.

The mixer drum rotates in three modes, namely an introduction mode M1 used to introduce a load, a stirring mode M2 used to stir the load, and a discharge mode M3 used to discharge the load.

When the fresh concrete is transported from a fresh concrete factory to a placement site, the fresh concrete serves as the load, but when the mixer drum M is returned to the fresh concrete factory while being cleaned by cleaning water after discharging the fresh concrete, the cleaning water serves as the load.

Referring to FIG. 1, the mixer drum driving device S will be described.

The mixer drum driving device S includes the mixer drum M, the hydraulic motor 1 that drives the mixer drum M to rotate, a first hydraulic pump 2 that is driven by an engine E of the mixer truck V to be capable of supplying working oil (pressure oil) to the hydraulic motor 1, a second hydraulic pump 3 capable of supplying working oil to the hydraulic motor 1, a motor 4 that drives the second hydraulic pump 3, and a flow dividing valve 5 that divides the working oil discharged from the first hydraulic pump 2 and supplies the divided working oil to the hydraulic motor 1 and the second hydraulic pump 3.

The hydraulic motor 1 is capable of bidirectional rotation. The hydraulic motor 1 includes a positive rotation side port 1*a* and a reverse rotation side port 1*b* through which the working oil passes. The positive rotation side port 1*a* and the reverse rotation side port 1*b* are connected to the first hydraulic pump 2 by a loop form first supply passage 6. The working oil discharged from the first hydraulic pump 2 circulates through the first supply passage 6 so as to pass through the hydraulic motor 1 and return to the first hydraulic pump 2.

The first supply passage 6 is constituted by a positive rotation side supply passage 6*a* that connects the positive rotation side port 1*a* of the hydraulic motor 1 to the first hydraulic pump 2, and a reverse rotation side supply passage 6*b* that connects the reverse rotation side port 1*b* of the hydraulic motor 1 to the first hydraulic pump 2. The hydraulic motor 1 is configured to rotate in the positive direction upon reception of a supply of working oil from the positive rotation side port 1*a*, thereby driving the mixer drum M to rotate in the positive direction, and to rotate in reverse upon reception of a supply of working oil from the reverse rotation side port 1*b*, thereby driving the mixer drum M to rotate in reverse. A reduction gear may be provided between the hydraulic motor 1 and the mixer drum M.

The first hydraulic pump 2 is a variable volume piston pump capable of adjusting a working oil discharge amount. The first hydraulic pump 2 is coupled to the engine E of the mixer truck V via a PTO 7 and driven to rotate by power from the engine E. When driven by the engine E, the first hydraulic pump 2 discharges working oil in a single direction.

In order to rotate the hydraulic motor 1 in two directions using the single direction discharge first hydraulic pump 2, a first direction switching valve 8 for switching a flow direction of the working oil is provided in the middle of the first supply passage 6. The first direction switching valve 8 may be provided separately to the first hydraulic pump 2 or built into the first hydraulic pump 2.

The first direction switching valve 8 attached to the first supply passage 6 is a four-port, three-position direction switching valve. The first direction switching valve 8 includes a positive rotation position 8*a* in which the working oil from the first hydraulic pump 2 is allowed to flow to the positive rotation side port 1*a* of the hydraulic motor 1 through the positive rotation side supply passage 6*a*, a reverse rotation position 8*b* in which the working oil from the first hydraulic pump 2 is allowed to flow to the reverse rotation side port 1*b* of the hydraulic motor 1 through the reverse rotation side supply passage 6*b*, and a blocking position 8*c* in which a connection between the hydraulic motor 1 and the first hydraulic pump 2 is blocked.

The second hydraulic pump 3 is provided in a loop form second supply passage 10 together with the hydraulic motor 1 and a tank 9 that stores the working oil. The working oil in the tank 9 that is discharged from the second hydraulic pump 3 circulates through the second supply passage 10 so as to pass through the hydraulic motor 1 and return to the tank 9.

The second supply passage 10 includes a low pressure passage 10*a* that connects the tank 9 to the second hydraulic pump 3, a high pressure passage 10*b* that connects the second hydraulic pump 3 to the positive rotation side port 1*a* of the hydraulic motor 1, and a return passage 10*c* that connects the reverse rotation side port 1*b* of the hydraulic motor 1 to the tank 9. A part of a pipe constituting the high pressure passage 10*b* and a part of a pipe constituting the return passage 10*c* are shared with a pipe constituting the first supply passage 6. In FIG. 1, to facilitate understanding, the first supply passage 6 is shown by a solid line and the second supply passage 10 is shown by a dotted line.

The second hydraulic pump 3 is coupled to the motor 4. The second hydraulic pump 3 is configured to discharge working oil suctioned from the tank 9 when driven by the motor 4. The second hydraulic pump 3 is also configured to drive the motor 4 to rotate when driven by a supply of working oil.

The motor 4 is a direct current brush electric motor which is connected to the power supply B so as to rotate in one direction. When a switch 11 is switched ON such that electric power is supplied from the power supply B, the motor 4 drives the second hydraulic pump 3 to rotate. When the second hydraulic pump 3 is driven by the motor 4, the second hydraulic pump 3 can supply working oil to the positive rotation side port 1*a* of the hydraulic motor 1 through the second supply passage 10.

When the second hydraulic pump 3 is driven by the supply of working oil, the motor 4 rotates so as to generate electric power on the basis of a driving force of the second hydraulic pump 3. Thus, the motor 4 functions not only as a drive source for driving the second hydraulic pump 3, but also as a power generator that is driven by the second hydraulic pump 3 to generate electric power. The electric power generated by the motor 4 is supplied to the power supply B via a charging circuit 12. As a result, the power supply B is charged. It should be noted that the power supply B is configured to be charged also by an alternator caused to generate electric power by engine rotation.

The flow dividing valve 5 is a member that divides the working oil discharged from the first hydraulic pump 2. The flow dividing valve 5 includes an inflow port 5*a*, a priority port 5*b*, and a surplus port 5*c*. The flow dividing valve 5 divides working oil supplied to the inflow port 5*a* between two ports, namely the priority port 5*b* and the surplus port 5*c*. When an amount of working oil flowing into the inflow port 5*a* does not satisfy a predetermined amount, the flow dividing valve 5 discharges the working oil through the priority port 5*b* alone, and when the amount of working oil exceeds the predetermined amount, the flow dividing valve 5 discharges the predetermined amount of working oil through the priority port 5*b* and discharges the surplus working oil through the surplus port 5*c*.

Hence, the flow dividing valve 5 is formed as a priority type flow dividing valve that includes a pressure compensating flow dividing spool 5*e* and a variable throttle 5*d* provided on the priority port 5*b* side, and causes the working oil to flow through the priority port 5*b* preferentially over the surplus port 5*c*. It should be noted that the flow dividing valve 5 is not limited to the priority type structure described above, and may simply divide the flow of working oil into two.

The flow dividing valve 5 is provided in the middle of a flow dividing circuit 13. The flow dividing circuit 13 includes an introduction passage 13*a* that leads the working oil to the inflow port 5*a* of the flow dividing valve 5, a driving passage 13*b* that connects the priority port 5*b* of the flow dividing valve 5 to the positive rotation side supply passage 6*a* of the first supply passage 6, and a regeneration passage 13*c* that connects the surplus port 5*c* of the flow dividing valve 5 to the high pressure passage 10*b* of the second supply passage 10.

A check valve 13*d* is provided in the driving passage 13*b*, and a check valve 13*e* is provided in the regeneration passage 13*c*. Thus, the driving passage 13*b* serves as a unidirectional passage that allows the working oil to flow only from the priority port 5*b* toward the positive rotation side supply passage 6*a*, while the regeneration passage 13*c* serves as a unidirectional passage that allows the working oil to flow only from the surplus port 5*c* toward the high pressure passage 10*b*.

A second direction switching valve 14 for switching a flow direction of the working oil is provided in the middle of the first supply passage 6 and the second supply passage 10. The second direction switching valve 14 is disposed to intersect the positive rotation side supply passage 6*a* and reverse rotation side supply passage 6*b* of the first supply passage 6 and the low pressure passage 10*a*, high pressure passage 10*b*, and return passage 10*c* of the second supply passage 10.

As shown in FIG. 3, the second direction switching valve 14 attached to the first supply passage 6 and the second supply passage 10 is an eleven-port, three-position direction switching valve. The second direction switching valve 14 includes a total of eleven ports P1 to P11.

A port P1 is connected to the high pressure passage 10*b* on the hydraulic motor 1 side, and a port P7 is connected to the high pressure passage 10*b* on the second hydraulic pump 3 side. A port P2 is connected to an end portion of the return passage 10*c* of the second supply passage 10. A port P3 is connected to the positive rotation side supply passage 6*a* on the first hydraulic pump 2 side, and a port P9 is connected to the positive rotation side supply passage 6*a* on the hydraulic motor 1 side. A port P4 is connected to the reverse rotation side supply passage 6*b* on the first hydraulic pump 2 side, and a port P10 is connected to the reverse rotation side supply passage 6*b* on the hydraulic motor 1 side. A port P5 is connected to an end portion of a regeneration return passage 16 (see FIG. 1) that communicates with the reverse rotation side supply passage 6*b*. A port P6 is connected to the low pressure passage 10*a* on the tank 9 side, and a port P11 is connected to the low pressure passage 10*a* on the second hydraulic pump 3 side. A port P8 is connected to an end portion of the introduction passage 13*a* in the flow dividing circuit 13.

Further, the second direction switching valve 14 includes a first supply position 14*a* in which only the working oil discharged from the first hydraulic pump 2 is supplied to the hydraulic motor 1, a regeneration position 14*b* in which the working oil discharged from the first hydraulic pump 2 is supplied to the hydraulic motor 1 and the second hydraulic pump 3 via the flow dividing valve 5, and a second supply position 14*c* in which only the working oil discharged from the second hydraulic pump 3 is supplied to the hydraulic motor 1.

In the first supply position 14*a*, the port P1, the port P5, and the port P8 are closed, the port P2 communicates with the port P7 such that the high pressure passage 10*b* is connected to the return passage 10*c*, the port P3 communicates with the port P9 such that the positive rotation side supply passage 6*a* is communicative, the port P4 communicates with the port P10 such that the reverse rotation side supply passage 6*b* is communicative, and the port P6 communicates with the port P11 such that the low pressure passage 10*a* is communicative.

Hence, when the position of the second direction switching valve 14 corresponds to the first supply position 14*a*, only the working oil discharged from the first hydraulic pump 2 is supplied to the hydraulic motor 1 through the positive rotation side supply passage 6*a*. Even when the motor 4 drives the second hydraulic pump 3 at this time, the working oil discharged from the second hydraulic pump 3 flows into the return passage 1*c* from the high pressure passage 10*b* and is returned to the tank 9 without passing through the hydraulic motor 1.

In the regeneration position 14*b*, the port P1, the port P2, the port P6, the port P7, and the port P9 are closed, the port P3 communicates with the port P8 such that the positive rotation side supply passage 6*a* is connected to the introduction passage 13*a*, the port P4 communicates with the port P10 such that the reverse rotation side supply passage 6*b* is communicative, and the port P5 communicates with the port P11 such that the low pressure passage 10*a* is connected to the regeneration return passage 16.

Hence, when the position of the second direction switching valve 14 corresponds to the regeneration position 14*b*, the working oil discharged from the first hydraulic pump 2 flows into the introduction passage 13*a* from the positive rotation side supply passage 6*a*, and is then supplied to the hydraulic motor 1 and the second hydraulic pump 3 via the flow dividing valve 5. The working oil that passes through the second hydraulic pump 3 flows into the reverse rotation side supply passage 6*b* through the low pressure passage 10*a* and the regeneration return passage 16, and is then returned to the first hydraulic pump 2 together with the working oil that has passed through the hydraulic motor 1.

It should be noted that the regeneration return passage 16 includes a check valve 19 so that working oil does not flow into the regeneration return passage 16 from the reverse rotation side supply passage 6*b* when the mixer drum M is rotated in reverse.

In the second supply position 14*c*, the port P3, the port P4, the port P5, the port P8, and the port P9 are closed, the port P1 communicates with the port P7 such that the high pressure passage 10*b* is communicative, the port P2 communicates with the port P10 such that the reverse rotation side supply passage 6*b* is connected to the return passage 10*c*, and the port P6 communicates with the port P11 such that the low pressure passage 10*a* is communicative.

Hence, when the position of the second direction switching valve 14 corresponds to the second supply position 14*c*, only the working oil suctioned from the tank 9 through the low pressure passage 10*a* and discharged by the second hydraulic pump 3 is supplied to the hydraulic motor 1 through the high pressure passage 10*b*. The working oil that passes through the hydraulic motor 1 is returned to the tank 9 through the return passage 10*c*. At this time, the connection between the first hydraulic pump 2 and the hydraulic motor 1 is blocked.

It should be noted that in the present embodiment, the second direction switching valve 14 is constituted by a single direction switching valve, but the functions of the second direction switching valve 14 may be satisfied using a plurality of direction switching valves.

As shown in FIG. 1, the mixer drum driving device S is provided with a selection lever 17 so that an operator of the mixer truck V can select the rotation mode of the mixer drum M. The operator can select the rotation mode of the mixer drum M by operating the selection lever 17 in a direction indicated by a dotted line arrow. The rotation modes of the mixer drum M are the introduction mode Ml, in which the mixer drum M is rotated in the positive direction at a high speed, the stirring mode M2, in which the mixer drum M is rotated in the positive direction at a low speed, and the discharge mode M3, in which the mixer drum M is rotated in reverse at a high speed. The stirring mode M2 includes two modes, namely a normal stirring mode and a regeneration stirring mode, and the normal stirring mode and regeneration stirring mode are also selected in accordance with the position of the selection lever 17.

The selection lever 17 is coupled to a governor of the engine E via a link or the like such that when the selection lever 17 is operated to the introduction mode M1 or the discharge mode M3, a rotation speed of the engine E increases, whereby the mixer drum M is set to rotate at a high speed.

The mixer drum driving device S described above further includes a controller 18 for controlling operations of the first direction switching valve 8, the second direction switching valve 14, and so on. The controller 18 controls an actuator such as a solenoid that switches the respective positions of the first direction switching valve 8 and the second direction switching valve 14 in accordance with the position of the selection lever 17.

In the introduction mode M1, the position of the first direction switching valve 8 is switched to the position 8*a* for supplying working oil to rotate the hydraulic motor 1 in the positive direction, while the position of the second direction switching valve 14 is switched to the first supply position 14*a* in which only the working oil discharged from the first hydraulic pump 2 is supplied to the hydraulic motor 1. In the discharge mode M3, on the other hand, the position of the first direction switching valve 8 is switched to the position 8*b* for supplying working oil to rotate the hydraulic motor 1 in reverse, while the position of the second direction switching valve 14 is switched to the first supply position 14*a* in which only the working oil discharged from the first hydraulic pump 2 is supplied to the hydraulic motor 1.

Hence, in the introduction mode M1 and the discharge mode M3, the mixer drum M is driven to rotate only by the first hydraulic pump 2, which is driven by the engine E.

In the normal stirring mode of the stirring mode M2, the position of the first direction switching valve 8 is switched to the position 8*a* for supplying working oil to rotate the hydraulic motor 1 in the positive direction, the position of the second direction switching valve 14 is switched to the second supply position 14*c* in which only the working oil discharged from the second hydraulic pump 3 is supplied to the hydraulic motor 1, and the switch 11 is switched ON to drive the motor 4. In the normal stirring mode, a constant current is supplied to the motor 4, and therefore the hydraulic motor 1 rotates at a constant speed. As a result, the mixer drum M rotates in the positive direction at a constant speed on the basis of driving force from the motor 4.

In the regeneration stirring mode of the stirring mode M2, the position of the first direction switching valve 8 is switched to the position 8*a* for supplying working oil to rotate the hydraulic motor 1 in the positive direction, and the position of the second direction switching valve 14 is switched to the regeneration position 14*b* in which the working oil discharged from the first hydraulic pump 2 is divided. In the regeneration stirring mode, the working oil discharged from the first hydraulic pump 2 is supplied to the hydraulic motor 1 and the second hydraulic pump 3 via the flow dividing valve 5. The hydraulic motor 1 rotates the mixer drum M in the positive direction upon reception of the supply of working oil. The second hydraulic pump 3 rotates the motor 4 upon reception of the supply of working oil. As a result, the motor 4 generates electric power, and the electric power generated by the motor 4 is supplied to the power supply B.

In the regeneration stirring mode, the working oil discharged from the first hydraulic pump 2 is divided by the flow dividing valve 5 and supplied to the hydraulic motor 1. The flow dividing valve 5 is a priority type flow dividing valve that causes a predetermined amount of the working oil to flow preferentially to the priority port 5*b*, and therefore, by setting an engine rotation speed during idling such that the amount of working oil discharged from the first hydraulic pump 2 equals or exceeds the predetermined amount, the predetermined amount of working oil can be supplied to the hydraulic motor 1 from the priority port 5*b* of the flow dividing valve 5 even when the amount of working oil discharged from the first hydraulic pump 2 varies in accordance with the engine rotation speed.

Hence, the mixer drum M can be rotated at a constant speed regardless of the rotation speed of the engine E. When the rotation speed of the engine E increases as the mixer truck V travels such that the amount of working oil discharged from the first hydraulic pump 2 exceeds the predetermined amount, the surplus working oil is supplied to the second hydraulic pump 3 from the surplus port 5*c* of the flow dividing valve 5. The motor 4 generates electric power on the basis of the driving force of the second hydraulic pump 3, and the power supply B is charged thereby. The engine rotation speed during idling is set such that the amount of working oil discharged from the first hydraulic pump 2 equals or exceeds the amount, and therefore, in the regeneration stirring mode, the surplus working oil is always supplied to the second hydraulic pump 3 in order to charge the power supply B.

It should be noted that the first hydraulic pump 2 may be provided with a regulating mechanism that automatically regulates a tilt angle of a swash plate of the first hydraulic pump 2 so that the amount of discharged working oil remains constant regardless of the engine rotation speed. Likewise in this case, by setting the amount of working oil discharged from the first hydraulic pump 2 to equal or exceed the predetermined amount, the mixer drum M can be rotated at a constant speed regardless of the engine rotation speed. Further, since the surplus working oil is supplied to the second hydraulic pump 3, the power supply B can be charged using the surplus working oil.

In the mixer drum driving device S according to the present embodiment, electric power is generated by the motor 4 using the working oil discharged from the first hydraulic pump 2, which is driven by the engine E, and the generated electric power is supplied to the power supply B. Therefore, an amount of electric power generated to charge the power supply B is increased in comparison with a conventional mixer drum driving device. As a result, a frequency with which the power supply B is charged using a commercial power supply can be reduced.

Further, the motor 4 functions not only as a drive source for driving the second hydraulic pump 3, but also as a power generator for charging the power supply B. There is therefore no need to provide a separate power generator driven by the engine E in order to drive the motor 4, and as a result, a weight of the mixer drum driving device S can be reduced. Since the separate power generator is not mounted on the frame C, there is no need to reduce an amount of carried fresh concrete.

Hence, according to the mixer drum driving device S, the weight of the device can be reduced, and the mixer drum M can be driven to rotate using the motor 4 without the need for frequent charging of the power supply B using a commercial power supply.

In the mixer drum driving device S, working oil is supplied from the first hydraulic pump 2 to the second hydraulic pump 3 in order to charge the power supply B using the motor 4 only when the mixer drum M is rotated for stirring. Therefore, the power of the engine E does not have to be allocated to the motor 4 when the mixer drum M is rotated at a high speed during introduction and discharge, and as a result, increases in noise generation and fuel consumption can be suppressed during rotation for introduction and discharge.

In the mixer drum driving device S, the flow dividing valve 5 is a priority type flow dividing valve that causes part the predetermined amount of working oil to flow preferentially to the hydraulic motor 1, and therefore the mixer drum M can be rotated at a constant speed regardless of the engine rotation speed. When the amount of working oil discharged from the first hydraulic pump 2 equals or exceeds the predetermined amount, electric power can be generated by the motor 4. As a result, a power source of the engine E is not consumed wastefully.

The mixer drum driving device S includes the first supply passage 6 that can supply the working oil discharged from the first hydraulic pump 2 to the hydraulic motor 1, the first direction switching valve 8 that can switch the direction in which the working oil discharged from the first hydraulic pump 2 is supplied to the hydraulic motor 1, the second supply passage 10 that can supply the working oil discharged from the second hydraulic pump 3 to the hydraulic motor 1 so that the mixer drum M is rotated for stirring, and the second direction switching valve 14 provided in the middle of the first supply passage 6 and the second supply passage 10. The second direction switching valve 14 includes the first supply position 14*a* in which only the working oil discharged from the first hydraulic pump 2 is supplied to the hydraulic motor 1, the regeneration position 14*b* in which the working oil discharged from the first hydraulic pump 2 is supplied to the hydraulic motor 1 and the second hydraulic pump 3 via the flow dividing valve 5, and the second supply position 14*c* in which only the working oil discharged from the second hydraulic pump 3 is supplied to the hydraulic motor 1. Hence, with a comparatively simple configuration, the mixer drum M can be rotated for introduction and discharge using the engine E, the mixer drum M can be rotated for stirring using the motor 4, and the power supply B can be charged while rotating the mixer drum M for stirring using the engine E.

The mixer drum driving device S according to the present embodiment is configured such that the normal stirring mode and the regeneration stirring mode are selected using the selection lever 17, but the mixer drum driving device S is not limited to this configuration, and instead, the mixer drum driving device S may be configured such that only the normal stirring mode can be selected using the selection lever 17. In this case, the regeneration stirring mode is set by switching the first direction switching valve 8 and the second direction switching valve 14 when a state of charge of the power supply B is low. The state of charge of the power supply B is determined on the basis of a detection signal from a state of charge monitoring sensor disposed on the power supply B. When the state of charge of the power supply B has been restored to a sufficient state to drive the motor 4, the first direction switching valve 8 and second direction switching valve 14 are switched to shift from the regeneration stirring mode to the normal stirring mode, and the switch 11 is switched ON to drive the motor 4.

The mixer drum driving device S according to the present embodiment supplies working oil from the first hydraulic pump 2 to the second hydraulic pump 3 so that the power supply B is charged by the motor 4 only when the mixer drum M is rotated for stirring. However, working oil may also be supplied to the second hydraulic pump 3 so that the power supply B is charged by the motor 4 when the mixer drum M is rotated for introduction or discharge.

Although the invention has been described above with reference to certain embodiments, the invention is not limited to the embodiments described above. Modifications and variations of the embodiments described above will occur to those skilled in the art, within the scope of the claims.

The contents of JP2011-065504, with a filing date of Mar. 24, 2011 in Japan, are hereby incorporated by reference.

The invention claimed is:

1. A mixer drum driving device that is configured to rotate a mixer drum mounted on a frame of a mixer truck, comprising:

a hydraulic motor that is configured to rotate the mixer drum;

a first hydraulic pump that is configured to be driven by an engine of the mixer truck to be capable of supplying a working oil to the hydraulic motor;

an electric motor that is configured to function as a drive source or a power generator;

a power supply connected to the electric motor;

a second hydraulic pump that is configured to be capable of supplying the working oil to the hydraulic motor on the basis of a driving force of the electric motor; and a flow dividing valve that is configured to divide the working oil discharged from the first hydraulic pump and to supply the working oil to the hydraulic motor and the second hydraulic pump, wherein the second hydraulic pump is configured to rotate the electric motor when driven by the working oil supplied via the flow dividing valve, and the electric motor is configured to generate electric power when driven to rotate by the second hydraulic pump and to supply the electric power to the power supply.

2. The mixer drum driving device as defined in claim 1, wherein the flow dividing valve is configured to divide the working oil discharged from the first hydraulic pump only when the mixer drum is rotated for stirring.

3. The mixer drum driving device as defined in claim 2, wherein the flow dividing valve is configured to supply a predetermined amount of the working oil preferentially to the hydraulic motor.

4. The mixer drum driving device as defined in claim 1, further comprising:

a first supply passage that connects the first hydraulic pump and the hydraulic motor in loop form so as to supply the working oil discharged from the first hydraulic pump to the hydraulic motor;

a first direction switching valve provided in the first supply passage to be capable of switching a direction in which the working oil discharged from the first hydraulic pump is supplied to the hydraulic motor;

a second supply passage that connects a tank storing the working oil, the hydraulic motor, and the second hydraulic pump in loop form, and is configured to supply the working oil discharged from the second hydraulic pump to the hydraulic motor so that the mixer drum is rotated for stirring; and a second direction switching valve provided in the first supply passage and the second supply passage, wherein the second direction switching valve comprises:

a first supply position in which only the working oil discharged from the first hydraulic pump is supplied to the hydraulic motor;

a regeneration position in which the working oil discharged from the first hydraulic pump is supplied to the hydraulic motor and the second hydraulic pump via the flow dividing valve; and a second supply position in which only the working oil discharged from the second hydraulic pump is supplied to the hydraulic motor.

* * * * *